US009020403B2

(12) United States Patent
Noguchi et al.

(10) Patent No.: US 9,020,403 B2
(45) Date of Patent: Apr. 28, 2015

(54) DEVELOPING DEVICE

(75) Inventors: Akihiro Noguchi, Toride (JP); Satoru Stephen Yamauchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 13/326,689

(22) Filed: Dec. 15, 2011

(65) Prior Publication Data

US 2012/0163878 A1 Jun. 28, 2012

(30) Foreign Application Priority Data

Dec. 24, 2010 (JP) ..... 2010-288430

(51) Int. Cl.
*G03G 15/09* (2006.01)
*G03G 15/08* (2006.01)

(52) U.S. Cl.
CPC ..... *G03G 15/0921* (2013.01); *G03G 15/0812* (2013.01)

(58) Field of Classification Search
CPC ..... G03G 15/0921; G03G 15/0812
USPC ..... 399/274, 277
See application file for complete search history.

(56) References Cited

U.S. PATENT DOCUMENTS

| | | | | |
|---|---|---|---|---|
| 1,788,510 | A | 1/1931 | Everson | |
| 4,517,274 | A | 5/1985 | Honda et al. | |
| 5,212,525 | A | 5/1993 | Noami et al. | |
| 6,023,601 | A | 2/2000 | Hirosaki et al. | |
| 6,049,687 | A | 4/2000 | Hibino et al. | |
| 6,075,964 | A | 6/2000 | Ochiai et al. | |
| 6,081,684 | A * | 6/2000 | Naganuma et al. | 399/275 |
| 6,816,696 | B2 | 11/2004 | Nishizawa et al. | |
| 7,231,154 | B2 * | 6/2007 | Sakamaki | 399/27 |
| 7,263,318 | B2 | 8/2007 | Nishihama et al. | |
| 2006/0013622 | A1 | 1/2006 | Lee | |
| 2011/0158665 | A1 | 6/2011 | Yamauchi | |
| 2012/0099900 | A1 | 4/2012 | Noguchi et al. | |
| 2012/0195647 | A1 | 8/2012 | Nose et al. | |
| 2013/0016998 | A1 | 1/2013 | Noguchi et al. | |

FOREIGN PATENT DOCUMENTS

| | | | |
|---|---|---|---|
| JP | 60-112081 | A | 6/1985 |
| JP | 61-159673 | A | 7/1986 |
| JP | 5-6103 | A | 1/1993 |

(Continued)

OTHER PUBLICATIONS

Official Action dated Mar. 4, 2013, in Russian Application No. 2011152907/28 (079655).
Notification of the First Office Action dated Mar. 22, 2013, in Chinese Application No. 201110437943.7.

(Continued)

*Primary Examiner* — Gregory H Curran
(74) *Attorney, Agent, or Firm* — Fitzpatrick, Cella, Harper & Scinto

(57) ABSTRACT

A developing device includes a developing sleeve for carrying a developer for developing an electrostatic latent image formed on an image bearing member, a magnet for carrying the developer on the sleeve, and a regulating member for regulating an amount of the developer carried on the sleeve. Magnetic poles of the magnet are disposed so that a circumferential direction component of a magnetic force acting on a magnetic carrier of the developer contacting at least a part of an upstream regulating surface of the regulating member with respect to the direction of rotation of the sleeve is opposite from the direction of the rotation.

8 Claims, 12 Drawing Sheets

(56) References Cited

FOREIGN PATENT DOCUMENTS

| | | | |
|---|---|---|---|
| JP | 5-35067 | A | 2/1993 |
| JP | 06-083203 | A | 3/1994 |
| JP | 07-168443 | A | 7/1995 |
| JP | 08-123177 | A | 5/1996 |

OTHER PUBLICATIONS

Russian Decision on Granted dated Jul. 2, 2013, in related Russian Patent Application No. 2011152907/28 (079655) (with English translation).

Korean Office Action dated Apr. 14, 2014, in related Korean Patent Application No. 10-2011-141212.

* cited by examiner

DEVELOPING DEVICE

FIELD OF THE INVENTION AND RELATED ART

The present invention relates to a developing device for forming a visible image by depositing a developer on an electrostatic latent image formed an image bearing member.

The developing device is, e.g., used in an image forming apparatus, of an electrophotographic type or an electrostatic recording type, such as a copying machine, a laser beam printer, a facsimile machine or a malfunction machine of these machines. In a conventional image forming apparatus of the electrophotographic type, in general, a surface of a drum-like photosensitive member which is the image bearing member is electrically charged uniformly by a charger and then the charged photosensitive member is exposed to light depending on image information by an exposure device to form the electrostatic latent image on the photosensitive member. The electrostatic latent image formed on the photosensitive member is visualized as a toner image by a toner as the developer by using the developing device. Then, the visualized image is transferred onto a recording material by a transfer device. Thereafter, the toner image transferred on the recording material is melt-fixed on the recording material under heat and pressure by fixing device.

As such a developing device, there is a developing device using, as the developer, a two-component developer including non-image toner particles (toner) and magnetic carrier particles (carrier). Particularly, in a color image forming apparatus, the toner may contain no magnetic material and therefore the two-component developer has been widely used for the reason such that color (tilt) is good or the like. In the developing device using this two-component developer, in a developing container, the toner and the carrier are fed while being stirred and then the developer is carried on a developing sleeve as a developer carrying member. The developer carried on the developing sleeve is regulated in carrying amount by a regulating blade as a regulating member. Thereafter, a developing bias is applied between the developing sleeve and the photosensitive member and thereby only the toner is transferred onto the electrostatic latent image formed on the photosensitive member surface, so that the toner image corresponding to the electrostatic latent image is formed on the photosensitive member surface.

The above-described developing device includes, as shown in FIG. 12, a magnet (multi-pole magnet) 45A as a magnetic field generating means provided in a rotating developing sleeve 44. The magnet 45A has a plurality of magnetic poles N1, N2, S1 and S2. Incidentally, a rectilinear line in a radial direction represented by a lead line for each of the magnetic poles shows a peak position of a magnetic flux density of each of the positions.

The developer stirred and fed in a developing container 41 of the developing device is scooped at an N2 pole (scooping pole) to be carried on an outer peripheral surface of the developing sleeve 44. Then, by rotation of the developing sleeve 44, as indicated by an arrow A, the developer is fed to a developer stagnating portion 48 and an amount thereof is regulated by a developer returning member 47. Then, in order to constrain a stabilized developer, the developer is sufficiently constrained at an S2 pole (cut pole) having a magnetic flux density not less than a certain value and then is conveyed by a developing sleeve 44 while forming a magnetic chain.

Then, the developer carried on the developing sleeve 44 is regulated in its amount by cutting the magnetic chain by a regulating blade 46. The developer regulated in carrying amount is conveyed to an S1 pole (developing pole), which is an opposing portion to the photosensitive member, via an N1 pole and then develops the electrostatic latent image on the photosensitive member surface with the toner as described above. The developer remaining on the surface of the developing sleeve 44 after the development is separated from the developing sleeve 44 between an N3 pole and the N2 pole which are repelling poles and then is collected in the developing container 41.

As described above, in the case of a structure in which the developer carried on the developing sleeve 44 is regulated in amount by the regulating blade, the developer which cannot pass through a spacing (gap) between the developing sleeve 44 and the regulating blade 46 can form an immobile layer. That is, in the case of the conventional developing device, the magnet 45A was constituted so that a force in a direction (arrow B direction) toward the regulating blade 46 acted on the magnetic carrier upstream of the regulating blade 46 with respect to a circumferential direction of rotation (rotational direction) of the developing sleeve 44. For this reason, the developer which cannot pass through the gap and stagnates upstream of the regulating blade 46 as described above is pressed against an upstream surface of the regulating blade 46, so that the immobile layer in which there is no motion of the developer (or motion of the developer is less than that of another portion) is liable to be formed.

Thus, when the immobile layer is formed on the upstream surface of the regulating blade 46, the developer is rubbed at a boundary surface between the immobile layer and a layer (flowable layer) of the developer carried and conveyed by the developing sleeve 44. As a result, e.g., the toner is liberated from the carrier by the rubbing and then the liberated toner particles are liable to be adhered to each other by frictional heat due to further rubbing, thus forming the immobile layer of the toner. The thus formed immobile layer grows by the rotation of the developing sleeve 44, so that a gap between the immobile layer and the developing sleeve 44 becomes smaller than the gap between the regulating blade 46 and the developing sleeve 44. Then, the carrying amount of the developer carried and conveyed on the developing sleeve 44 is regulated by the gap between the immobile layer and the developing sleeve 44, so that the carrying amount of the developer becomes smaller than a set amount. As a result, an amount of the developer conveyed to a developing region where the developing sleeve 44 opposes the photosensitive member fluctuates, so that a density of the image to be formed is lowered or density non-uniformity occurs.

In order to prevent the formation of such an immobile layer, there is a structure in which a cylindrical (columnar) toner feeding member which rotates with a certain gap with a developing sleeve is provided upstream of a regulating blade (Japanese Laid-Open Patent Application (JP-A) Hei 5-35067). Further, there is also a structure in which a regulating blade is provided between repelling poles in order to uniformize a thickness of a layer of a developer carried on a developing sleeve (JP-A Hei 5-6103).

In the case of the structure described in JP-A Hei 5-35067, a bearing for supporting the toner feeding member and a driving means for driving the toner feeding member are required, so that it is inevitable that a constitution is complicated and a cost therefor is increased. In addition, the toner feeding member is driven in an opposite direction at a position where it opposes the developing sleeve and therefore strong stress is imposed on the developer, so that there is a possibility that the developer is deteriorated early. Further, in the case where the toner feeding member is rotated at high speed, due to heat generation, there is also a possibility that the developer is melted or adhered.

Further, in the case of the structure described in JP-A Hei 5-6103, the regulating blade is provided between the repelling magnetic poles and therefore an amount of the developed constrained in the neighborhood of the regulating blade is small, so that there is a possibility that it becomes difficult to stably supply the developer to the developing sleeve.

SUMMARY OF THE INVENTION

A principal object of the present invention is to provide a developing device capable of suppressing deterioration of a developer and stably supplying the developer to a developer carrying member and also capable of stably regulating an amount of the developer, carried on the developer carrying member, by a regulating member.

According to an aspect of the present invention, there is provided a developing device comprising: a developer carrying member for carrying a developer containing a magnetic carrier and a non-magnetic toner and for developing an electrostatic latent image formed on an image bearing member; a magnet, provided in the developer carrying member and including a plurality of magnetic poles disposed along a circumferential direction of the developer carrying member, for carrying the developer on the developer carrying member; and a regulating member, provided opposed to the developer carrying member with a predetermined spacing in a region in which the magnetic poles different in polarity are adjacent to each other, for regulating an amount of the developer carried on the developer carrying member, wherein the magnetic poles are disposed so that a circumferential direction component of a magnetic force acting on the magnetic carrier contacting at least a part of an upstream regulating surface of the regulating member with respect to the circumferential direction of rotation of the developer carrying member is opposite from the circumferential direction of rotation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1>

The First Embodiment of the present invention will be described with reference to FIGS. 1 to 9.

[Image Forming Apparatus]

Figure 1:
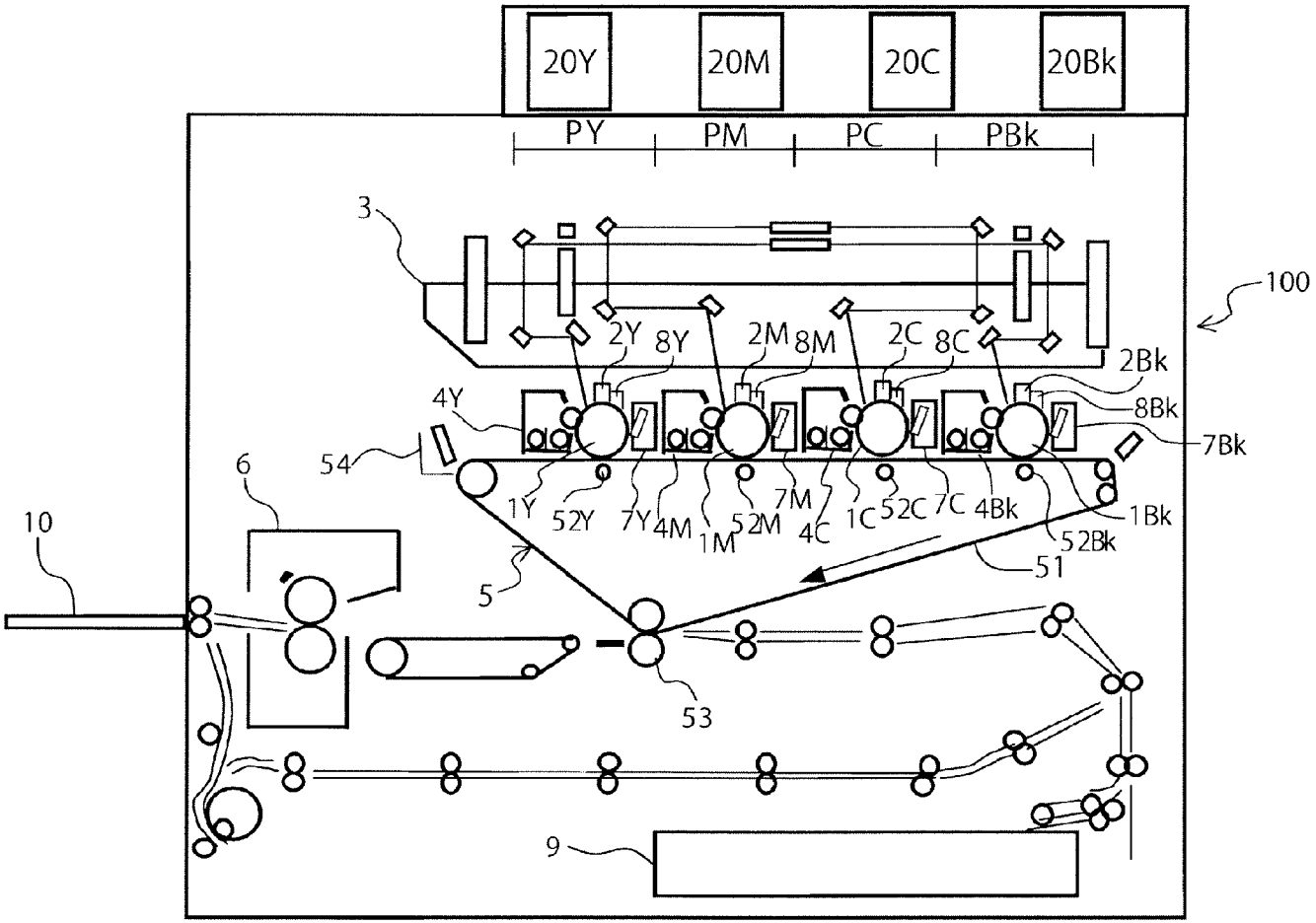
FIG. 1 is a schematic illustration of an image forming apparatus according to a First Embodiment of the present invention.

First, a general structure and operation of an image forming apparatus in this embodiment will be described with reference to FIG. 1. An image forming apparatus 100 forms images in accordance with image information from an original reading device connected to a main assembly of the image forming apparatus 10 or from a host device, such as a personal computer, which is communication connected to the main assembly. In this embodiment, four color-based full-color image of yellow (Y), magenta (M), cyan (C) and black (Bk) can be formed on a material (sheet of recording paper, a sheet of plastic, piece of fabric, etc.) by using an electrophotographic type.

Thus, the image forming apparatus 100 has a four-drum tandem type constitution and includes, as a plurality of image forming means, first to fourth image forming portions (image forming stations) PY, PM, PC and PBk, which form yellow, magenta, cyan and black (monochromatic) images, respectively. In a period in which an intermediary transfer belt 51 provided to a transferring device 5 as transferring means moves in an indicated arrow direction and passes through the respective image forming portions, the respective color toner images are superposed on the intermediary transfer belt 51. Then, the multiple toner image superposed on the intermediary transfer belt 51 are transferred onto the recording material to obtain a recording image. In this embodiment, as the developer, a two-component developer containing a non-magnetic toner and a magnetic carrier is used.

Incidentally, the respective image forming stations have the substantially same constitution except that they are different in development color. Hereinafter, in the case where there is no need to particularly differentiate the image forming station, suffixes Y, M, C and Bk which indicate elements belonging to associated image forming stations are omitted and will be collectively described.

The image forming station P includes a drum-like photosensitive member 1 (photosensitive drum) as an image bearing member. Around the photosensitive member 1, a charger 2 as a charging means, an exposure device 3 as an exposure means (e.g., laser exposure optical system), a developing device 4 as a developing means, the transferring device 5, a cleaning device 7 as a cleaning means, and a charge removing device 8 as a charge removing means are provided.

The transferring device 5 includes the intermediary transfer belt 51 as an intermediary transferring member. The intermediary transfer belt 51 is extended around a plurality of rollers, and is rotated (circularly moved) in the direction indicated by the arrow in FIG. 1. Further, a primary transferring member 52 is provided at a position where it opposes an associated photosensitive member 1 via the intermediary transfer belt 51. Further, a secondary transferring member 52 is provided at a position where it opposes one of the rollers around which the intermediary transfer belt 51 is extended.

During image formation, first, the (peripheral) surface of the rotating photosensitive member 1 is uniformly charged by the charger 2. Next, the charged surface of the photosensitive member 1 is subjected to scanning exposure by the exposure device 3 depending on an image information signal, so that an electrostatic latent image is formed on the photosensitive member 1 (image bearing member). The electrostatic latent image formed on the photosensitive member 1 is visualized as a toner image with the toner of the developer by the developing device 4. At that time, depending on an amount of consumed toner, a supply developer is supplied from a hopper 20 into the developing device 4 through an unshown supply path. The toner image formed on the photosensitive member 1 is transferred (primary-transferred) onto the intermediary transfer belt 51 by the action of a primary transfer bias applied to the primary transferring member 52, at a primary transfer portion (primary transfer nip), in which the intermediary transfer belt 51 and the photosensitive member 1 contact each other. For example, during four color-based full-color image formation, the toner images are sequentially transferred from the photosensitive members 1 of the for image forming portions, starting from the first image forming portion RY onto the intermediary transfer belt 51, so that a full (multi)-color image consisting of the superposed four color toner image is formed on the intermediary transfer belt 51.

Separately, the recording material accommodated in a cassette 9 is conveyed by recording medium conveying members, such as a pickup roller, conveyer rollers, registration rollers, and the like. This conveyance of the recording material is effected in synchronism with the toner image on the photosensitive member 1 at the second transfer portion (nip) where the intermediary transfer belt 51 and a secondary transferring member 53 contact each other. Then, the multiple toner images on the intermediary transfer belt 51 is transferred, at the secondary transfer portion, onto the recording material, by the action of the secondary transfer bias applied to the secondary transferring member 53.

Thereafter, the recording material is separated from the intermediary transfer belt 51 is conveyed to a fixing device 6. The counter images transferred on the recording material are subjected to the heat and pressure applied thereto by the fixing device 6, thus being melt and fixed on the recording material. Thereafter, the recording material is discharged to the outside of the image forming apparatus 100.

After the primary transfer step, a deposited matter such as the toner remaining on the photosensitive member 1 is collected by the cleaning device 7. Further, the electrostatic latent image remaining on the photosensitive member 1 is erased by the charge removing device 8. As a result, the photosensitive member 1 is prepared for a subsequent image forming step. Further, the deposited matter such as the toner remaining on the intermediary transfer belt 51 after the secondary transfer step is removed by an intermediary transfer belt cleaner 54.

Incidentally, the image forming apparatus 100 is also capable of forming an image of a single color (e.g., black) or a multicolor image by using the image forming portion for a desired single color or using two or more of the four image forming stations for some colors.

[Two-Component Developer]

Next, the two-component developer used in this embodiment is described. The toner contains colored particles made up of a binder resin, a coloring agent, colored resin particles containing other additives as desired, and external additives such as fine powder of colloidal silica. Further, the toner is formed of a negatively chargeable polyester resin material and is not less than 4.0 μm and not more than 1.0 μm in volume-average particle size d (4.0 μm-≤d≤10.0 μm), preferably be not less than 5.0 μm and not more than 8.0 μm (5.0 μm≤d≤8.0 μm). In this embodiment, d was 7.0 μm. In this embodiment, contains wax. The toner contains the wax in an amount of 1-20 wt. %. For this reason, the toner is obtained by kneading at least the binder resin, the coloring agent and the wax, and then by pulverizing the kneaded product.

As the material for the carrier, surface-oxidized or non-oxidized particles of a metallic substance, such as iron, nickel, cobalt, manganese, chrome, rare-earth metal and their alloys, or oxidized ferrite, and the like, can be suitably used. The method for manufacturing these magnetic particles is not particularly limited. Further, the carrier is 10.0 μm or more and 60.0μ or less, preferably be in a range of 20.0-60.0μ, further preferably 30.0-50.0 μm, in volume-average particle size D (10.0 μm≤D≤60.0 μm, preferably 20.0μ≤D≤60.0 μm, further preferably, 30.0 μm≤D≤50.0 μm). Further, a volume resistivity is not less than $10^7$ Ω.cm, preferably not less than $10^8$ Ω.cm and not more than $10^{14}$ Ω.cm. Further, an amount of magnetization is 30 emu/cc ($30\times10^3$ A/m) or more and 300 emu/cc ($300\times10^3$ A/m) or less. In this embodiment, the carrier which was 40 μm in volume average particle size D, $5\times10^8$ Ω.cm in volume resistivity, and 260 μm/cc ($260\times10^3$ A/m) in the amount of magnetization was used.

Incidentally, with respect to the toner, the volume-average particle size was measured with the use of the following apparatus and method. As the measuring apparatus, a Coulter Counter TA-AA (mfd. by Beckman Coulter Inc.), an interface (mfd. by Nikkaki-Bios K.K.) for outputting the number and volume average distributions of the developer, and a personal computer ("CX-1", mfd. by Canon K.K.) were used. As an electrolytic aqueous solution, 1% NaCl aqueous solution prepared by using a first class grade sodium chloride was used.

The measuring method is as follows. That is, 0.1 ml of a surfactant, preferably alkyl-benzene sulfonate, was added, as dispersant, into 10-150 ml of above-mentioned electrolytic aqueous solution. Then, 0.5-50 mg of a measurement sample was added to the above mixture. Then, the electrolytic aqueous solution in which the sample was suspended was subjected to dispersion by an ultrasonic dispersing device for about 1-3 minutes. Then, the distribution of the particles which were in a range of 2-40 μm in diameter was obtained with the use of the Coulter Counter TA-II fitted with a 100 μm aperture as an aperture. The volume-average particle size was obtained from the thus obtained volume-average distribution.

The resistivity of the magnetic carrier was measured in the following manner. That is, a cell of the sandwich type, which was 4 cm in the area (size) of each of its measurement electrodes, and was 0.4 cm in the gap between the electrodes, was used. Then, the resistivity was measured by a method in which the carrier resistivity was obtained from electric current which flowed through a circuit while 1 kg of weight was applied to one of the electrodes and a voltage E (V/cm) was applied between the two electrodes. Further, the volume-average particle size of the magnetic carrier was measured with the use of a particle size distribution measuring device ("HERO", mfd. by JEOL Ltd.) of the laser diffraction type (NEC Corp.), and the particle size range of 0.5-350 μm was, based on volume basis, logarithmically divided into 32 decades, and the number of particles in each decade was measured. Then, from the results of the measurement, the median diameter of 50% in volume was used as the volume-average particle size.

Further, the magnetic properties of the magnetic carrier were measured with the use of an automatic magnetic property recorder of vibratory (BHV-30 mfd. by Riken Denshi Co., Ltd.). As a magnetic characteristic value, the magnetic (magnetization) strength of the magnetic carrier was obtained by forming external magnetic fields, which were 795.7 kA/m and 79.58 kA/m, respectively. A sample of the magnetic carrier for measurement was prepared by packing the magnetic carrier in a cylindrical plastic container so as to be sufficiently dense. In this state, the magnetizing moment was measured and further, an actual weight of the sample was weighed to obtain the strength of magnetization (emu/g). Further, the true specific gravity of the magnetic carrier particles was obtained with the use of, e.g., a micromeritics gas pycnometer (AccuPyc 1330, mfd. by Shimazu Corp.) (which is an automatic densitometer of the dry type), or the like. The strength of magnetization per unit volume was obtained by multiplying the obtained strength of magnetization (per unit volume) by the true specific gravity.

Next, a degree of agglomeration (agglomerativeness) of the developer will be described. Here, the degree of agglomeration of the developer can be measured in terms of an angle of repose. A proper range of the angle of repose of the developer in this embodiment is 25-50 degrees, preferably 30-45 degrees. When the angle of repose of the two-component developer is smaller than 25 degrees, due to high flowability, problems of scattering and white dropout during transfer on the plurality of sheets of the recording material occur and a transfer property during a durability test (when printing on a large number of sheets is effected) cannot be sufficiently retained satisfactorily. Further, when the angle of repose is larger than 50 degrees, the levels of the scattering and white dropout at an initial printing state are good but during the durability test at high speed, the developing property is lowered and a load of the feeding screw is increased, thus leading to screw locking. Therefore, in this embodiment, the two-component developer with the angle of repose of 40 degrees is used.

Figure 2:
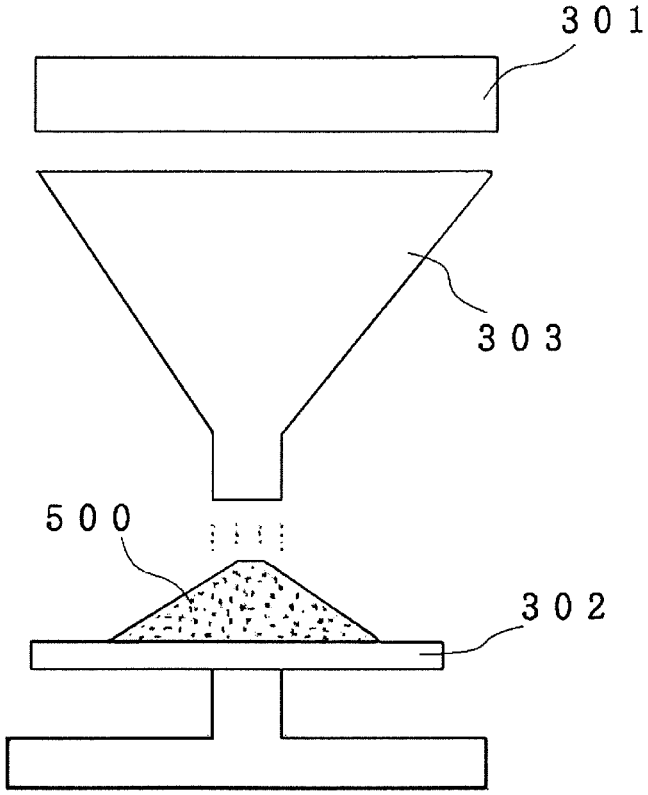
FIG. 2 is a schematic view for illustrating a measuring method of an angle of response.

FIG. 2 is a schematic view for illustrating an example of a method of measuring the angle of repose. In this embodiment, an angle of repose $\phi$ of the toner was measured by using the following method. First, a measuring apparatus is a powder tester ("PT-N", mfd. by Hosokawa Micron Corp.). Further, the measuring method is in accordance with measurement of the angle of repose in an operation manual attached to the powder tester (PT-N) (aperture of sieve 301: 710 μm, vibration time: 180 s, amplitude: 2 mm or less). The developer is dropped from a funnel 303 onto a disk 302, and an angle formed between a generating line of a developer 500 deposited in a conical shape on the disk 302 and the surface of the disk 302.

However, the sample is left standing overnight in an environment of 23° C. and a relative humidity of 60% (i.e., 60% RH) and then the angle of repose is measured and repeated five times in the measuring apparatus in the environment of 23° C. and 60% RH. An arithmetic average of the five measured values is used as $\phi$.

[Developing Device]

Figure 3:
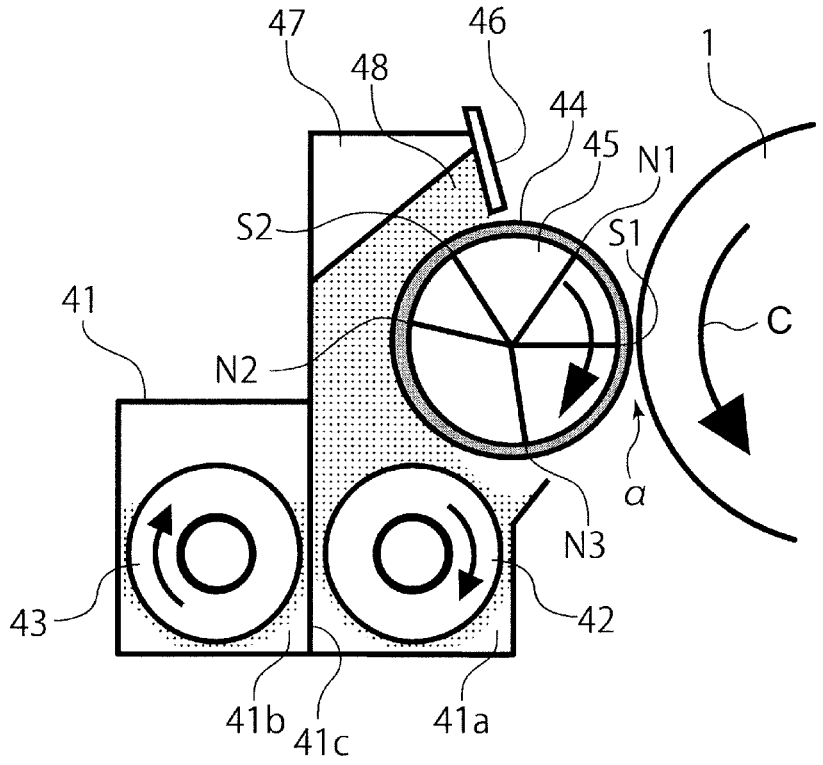
FIG. 3 is a schematic sectional view of a developing device in the First Embodiment.
Figure 4:
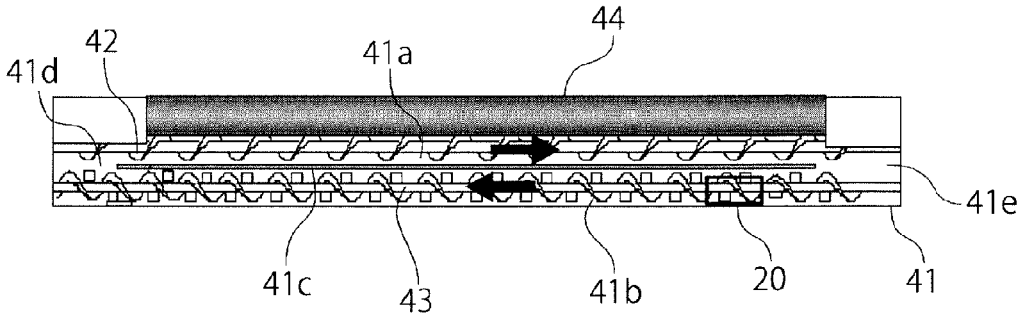
FIG. 4 is a partly cut view of the developing device as seen from above the developing device shown in FIG. 3.

Next, referring to FIGS. 3 and 4, the developing device 4 is described. The developing device 4 includes a developing container 41, in which the two-component developer containing the toner and the carrier is accommodated. The developing device 4 also includes, at a position where the developing container 41 opposes the photosensitive member 1, a developing sleeve 44 as a developer carrying means, and a regulating blade 46 as a regulating member for regulating a thickness of the chain of the developer carried on the developing sleeve 44.

Further, the inside of the developing container 41 is partitioned into a developing chamber 41*a* and a stirring chamber 41*b* by a partition wall 41*c* which extends in the direction perpendicular to the surfaces of the drawing sheets of FIGS. 2 and 3.

In the developing chamber 41*a* and stirring chamber 41*b*, first and second feeding screws 42 and 43 are provided, respectively, as a developer feeding member. The first feeding screw 42 is provided at the bottom of the developing chamber 41*a* and is substantially parallel to the axial direction of the developing sleeve 44, and conveys, while stirring, the developer in the development chamber 41*a* in one direction along the axial direction of the developing sleeve 44, by being rotated in the direction (clockwise direction) indicated by an arrow in FIG. 3. The reason why the first feeding screw 42 is rotated in the clockwise direction is that the clockwise direction is advantageous from the standpoint of supplying the developing sleeve 44 with the developer. Further, the second feeding screw 43 is provided at the bottom of the stirring chamber 41*b* and is substantially parallel to the first feeding screw 42, and conveys, while stirring, the developer in the stirring chamber 41*b* in a direction opposite from that by the first feeding screw 42 by being rotated in the opposite direction (counterclockwise direction) from the rotational direction of the first feeding screw 42.

Thus, by rotation for stirring of the first and second feeding screws 42 and 43, the developer is circulated between the developing chamber 41*a* and the stirring chamber 41*b* through openings (communicating portions) 41*d* and 41*e* passages at longitudinal ends of the partition wall 41*c*.

The developing container 41 is provided with an opening at a position corresponding to the developing region $\alpha$ where the positioning container 41 opposes the photosensitive member 1. At this opening, the developing sleeve 44 is rotatably provided so as to be partly exposed toward the photosensitive member 1. Further, the developing sleeve 44 and the photosensitive member 1 are brought near to and opposed to each other. For example, it is assumed that the developing sleeve 44 and the photosensitive member 1 are 20 mm and 80 mm, respectively, in diameter, and the closest distance therebetween is about 300 μm. As a result, setting is made so that the development can be effected in a state in which the developer fed by developing sleeve 44 to the developing region $\alpha$ is brought into contact with the photosensitive member 1.

Such a developing sleeve 44 is constituted in a cylindrical (columnar) shape by a nonmagnetic material such as aluminum or stainless steel. Inside the developing sleeve 44 (developer carrying member), a cylindrical magnet 45 which is a multi-pole magnet is provided in a stationary (non-rotational state). This magnet 45 has a plurality of magnetic poles disposed in its circumferential direction. Specifically, with respect to the rotational direction (arrow direction or clockwise direction) of the developing sleeve 44, the magnetic poles are arranged in the order of S1 pole as a developing disposed opposed to the magnet 1 in the developing region $\alpha$, an N3 pole, an N2 pole, an S2 pole and an N1 pole. Incidentally, in FIG. 3 and in FIGS. 5, 9 and 11 described later, a rectilinear line extending in the radial direction indicated by a lead line for each magnetic pole represents a peak position of a magnetic flux density of each magnetic pole.

During the development, the developing sleeve 44 is rotated (i.e., the developer is carried and conveyed) in a state in which the developer is carried on the developing sleeve 44 by a magnetic attraction force. The developing sleeve 44 carries the two-component developer regulated in layer thickness by cutting of the chain of the magnetic brush with the regulating blade 46 and conveys the developer to the developing region α in which the developing sleeve 44 opposes the photosensitive member 1. Then, the developing sleeve 44 supplies the developer to the electrostatic latent image formed on the photosensitive member 1 to develop the electrostatic latent image.

At this time, in order to improve a developing efficiency, i.e., a degree of impartment of the toner to the electrostatic latent image, a developing bias voltage in the form of a DC voltage biased (superposed) with an AC voltage is applied from a power source to the developing sleeve 44. In this embodiment, the DC voltage of −500 V and the AC voltage of 800 V in peak-to-peak voltage (Vpp) and 12 kHz in frequency (f) were used. However, the DC voltage value and the AC voltage waveform are not limited thereto. Further, in general, in a two-component magnetic brush developing method, when the AC voltage is applied, the developing efficiency is increased and thus the image is high in quality but is rather liable to cause fog. For this reason, the fog is prevented by providing a potential difference between the DC voltage applied to the developing sleeve 44 and a charge potential of the photosensitive member 1 (i.e., a white background portion potential).

In the developing region α, the developing sleeve 44 of the developing device 4 is rotated together with the photosensitive member 1 in the same direction as that of the photosensitive member 1, and a peripheral speed ratio of the developing sleeve 44 to the photosensitive member 1 is 1.75. The peripheral speed ratio may be set in a range of 0.5-2.5, preferably 1.0-2.0. When the movement (peripheral) speed ratio is larger, the developing efficiency is correspondingly increased. However, when the ratio is excessively large, problems of toner scattering developer deterioration and the like occur and therefore the peripheral speed ratio may preferably be set in the above-described ranges.

Further, the regulating blade 46 which is the regulating member (chain cutting member) is constituted by a non-magnetic member formed of aluminum or the like in a plate shape extending along a longitudinal axial line direction of the developing sleeve 44, and is provided upstream of the photosensitive member 1 with respect to the developing sleeve rotational direction. Further, the regulating member 46 is disposed opposed to the developing sleeve 44, thus regulating the amount of the developer carried on the developing sleeve 44. Then, both of the toner and the carrier which constitute the developer pass through the gap between an end of the regulating blade 46 and the developing sleeve 44 to be sent to the developing region α.

Incidentally, by adjusting the spacing (gap) between the end of the regulating blade 46 and the surface of the developing sleeve 44, a cutting amount of the chain of the magnetic brush of the developer carried on the developing sleeve 44 is regulated, so that the amount of the developer conveyed to the developing region α is adjusted. For example, a coating amount per unit area of the developer on the developing sleeve 44 is regulated at 30 mg/cm$^2$ by the regulating blade 46. Incidentally, the gap between the regulating blade 46 and the developing sleeve 44 is set at 200-1000 μm, preferably 300-700 μm. In this embodiment, the gap was set at 500 μm.

[Magnet (Multi-Pole Magnet)]

Next, the magnet 45 in this embodiment will be described with reference to FIGS. 5 to 9. A magnetic flux density relationship among the plurality of magnetic poles of the magnet 45 is set so that a circumferential (rotational) direction component (fθ) of the magnetic force acts, in the direction opposite from the rotational direction of the developing sleeve 44, on the magnetic carrier contacting the regulating blade 46 at the upstream side of the regulating blade 46 with respect to the rotational direction of the developing sleeve 44. That is, the magnetic flux density relationship among the plurality of magnetic poles is set so that the direction of the developing sleeve 44 rotational direction component of the magnetic force acting on the magnetic carrier contacting the upstream side of the regulating blade 46 with respect to the rotational direction of the developing sleeve 44 is opposite from the rotational direction of the developing sleeve 44. Incidentally, the rotational direction of the developing sleeve 44 indicated by an arrow C in each of FIGS. 3, 5, 6, 7, 9, 10 and 11 is hereinafter referred to as a sleeve rotational direction.

Figure 5:
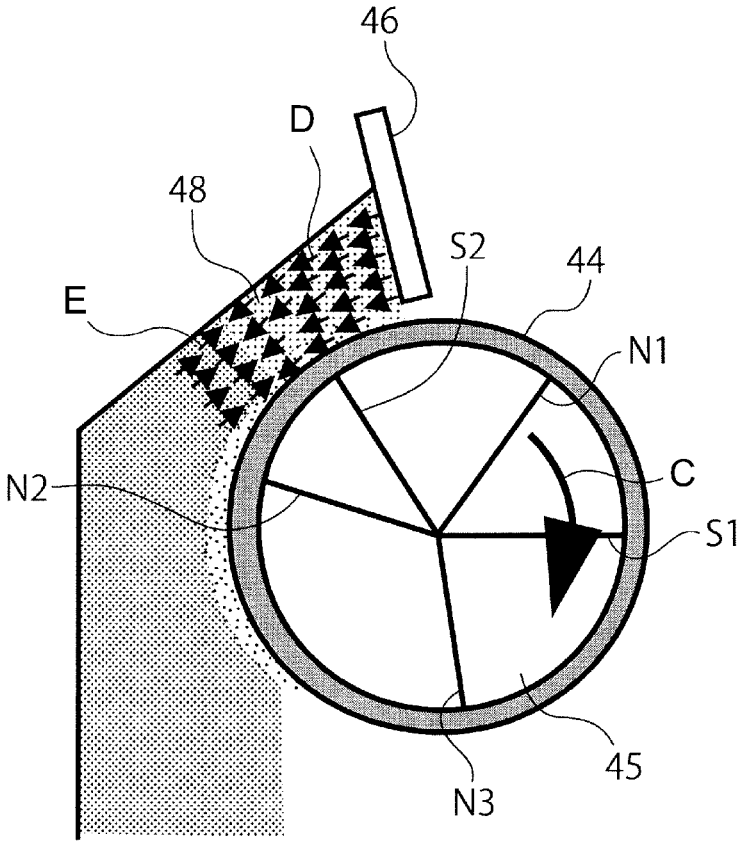
FIG. 5 is a partly enlarged view, of a part of FIG. 3, showing a two-dimensional distribution of fθ, with respect to a radial direction, in the neighborhood of a regulating blade in the First Embodiment.

Specifically, as shown in FIG. 5, the magnet 45 has the S2 pole and the N1 pole which are mutually different in polarity and are disposed in the neighborhood of the regulating blade 46. Of these poles, the S2 pole (cut pole) as a first magnetic pole has a magnetic flux density peak value at a position which is upstream of the regulating blade 46 with respect to the sleeve rotational direction and is closest to the regulating blade 46. Further, the N1 pole as a second magnetic pole has a magnetic flux density peak value at a position which is downstream of the regulating blade 46 with respect to the sleeve rotational direction and is closest to the regulating blade 46. Further, the magnet 45 has the N2 pole, as a third magnetic pole, which is disposed adjacent to and upstream of the S2 pole and which is different in polarity from the S2 pole.

In this embodiment, in order to direct the rotational direction component (Fθ) of the magnetic force in the direction opposite from the rotational direction of the developing sleeve 44, as a basic way of thinking, the magnetic flux density relationship may be designed in the following manner. That is, with respect to the magnetic pole closest to the regulating blade 46 (i.e., the cut pole (S2 pole in FIG. 5)), the intensity of the magnetic flux density of each of the magnetic poles N2 and N1 upstream and downstream of the cut pole with respect to the sleeve rotational direction and an interval between the cut pole and each of the magnetic poles N2 and N1 may be adjusted. Specifically, the magnetic force of the upstream magnetic pole N2 acting on the cut pole S2 may be made more intense than the magnetic force of the downstream magnetic pole N1 acting on the cut pole S2. As a method therefor, when the magnetic flux density of the magnetic pole immediately upstream of the cut pole is made larger than the magnetic flux density of the magnetic pole immediately downstream of the cut pole, the direction of the rotational direction component (Fθ) of the magnetic force approaches the direction opposite from the rotational direction of the developing sleeve 44.

Further, even in the case where the magnetic flux densities of the magnetic poles upstream and downstream of the cut pole are the same, when the magnetic pole upstream of the cut pole is brought near to the cut pole, the direction of the rotational direction component (Fθ) of the magnetic force can approach the direction opposite from the rotational direction of the developing sleeve 44. Further, also when a magnetic flux density half-width of the magnetic pole immediately upstream of the cut pole is made narrower than a magnetic flux density half-width of the magnetic pole immediately downstream of the cut pole, the magnetic force can be increased. Further, also in this case, the direction of the rotational direction component (Fθ) of the magnetic force can be brought near to the direction opposite from the rotational direction of the developing sleeve 44.

In this embodiment, as shown in FIG. 5, a sleeve rotational direction interval between the magnetic flux density peak value of the S2 pole and the magnetic flux density peak value of the N2 pole is made smaller than an sleeve rotational direction interval between the magnetic flux density peak value of the S2 pole and the magnetic flux density peak value of the N1 pole. Here, when the peak values and half-widths of the magnetic flux densities of the N1 pole and the N2 poles between which the S2 pole is interposed are the same, as described above, the interval between the magnetic flux density peak values of the S2 pole and the N2 pole may be made smaller than the interval between the magnetic flux density peak values of the S2 pole and the N1 pole. That is, when the peak value intervals are regulated as described above, with respect to the magnetic carrier contacting the upstream side of the regulating blade 46 with respect to the sleeve rotational direction, as indicated by arrows D in FIG. 5, the rotational direction component of the magnetic force acts in the direction opposite from the sleeve rotational direction. Incidentally, a similar effect is obtained also when the peak value or half-width of the magnetic flux density of the N2 pole is made larger than the peak value or half-width of the magnetic flux density of the N1 pole.

Figure 6:
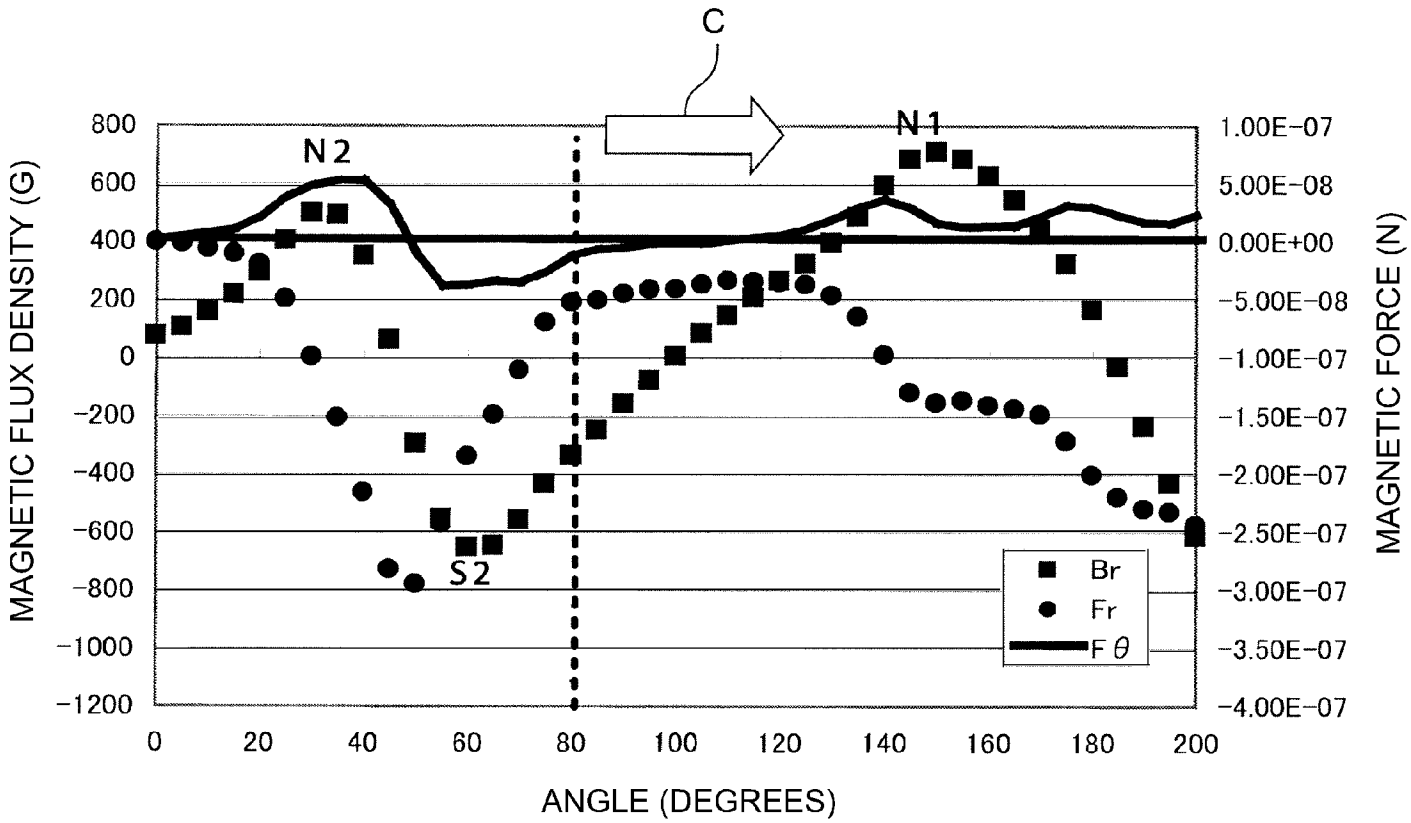
FIG. 6 is a graph showing a relationship between a magnetic flux density and a magnetic force in the neighborhood of the regulating blade in First Embodiment.

However, as shown in FIG. 6, even when the peak value or half-width of the magnetic flux density of the N2 pole is smaller than the peak value or half-width of the magnetic flux density of the N1 pole, the interval between the magnetic flux density peak values of the S2 pole and the N2 pole may be made smaller than the interval between the magnetic flux density peak values of the S2 pole and the N1 pole so as to cause the above-described magnetic force to act. That is, with respect to the peak values and half-widths of the magnetic flux densities of the magnetic poles N2, S2 and N1 in the neighborhood of the regulating blade 46, the intervals of these peak values are appropriately regulated. Then, the rotational direction component of the magnetic force is caused to act, in the direction opposite from the sleeve rotational direction, on the magnetic carrier contacting the upstream side of the regulating blade 46 with respect to the sleeve rotational direction.

This point will be described with reference to FIG. 6 to FIG. 8. FIG. 6 shows a relationship between the magnetic flux density and the magnetic force with respect to the rotational direction (angle) of the developing sleeve 44. Here, "Br" indicated by a (black) square mark is a radial direction component of the magnetic flux density, "Fr" indicated by a (black) circular mark is a radial direction component of the magnetic force acting on the magnetic carrier, and "Fθ" indicated by a line is a sleeve rotational direction component of the magnetic force acting on the magnetic carrier. Further, in the case where Fr is positive, the magnetic force acts in a divergent direction, i.e., a direction in which the magnetic force is moved away from the sleeve. In the case where Fθ is positive, the magnetic force acts in the sleeve rotational direction. Incidentally, "Bθ" is a sleeve rotational direction component of the magnetic force acting on the magnetic carrier.

Figure 7:
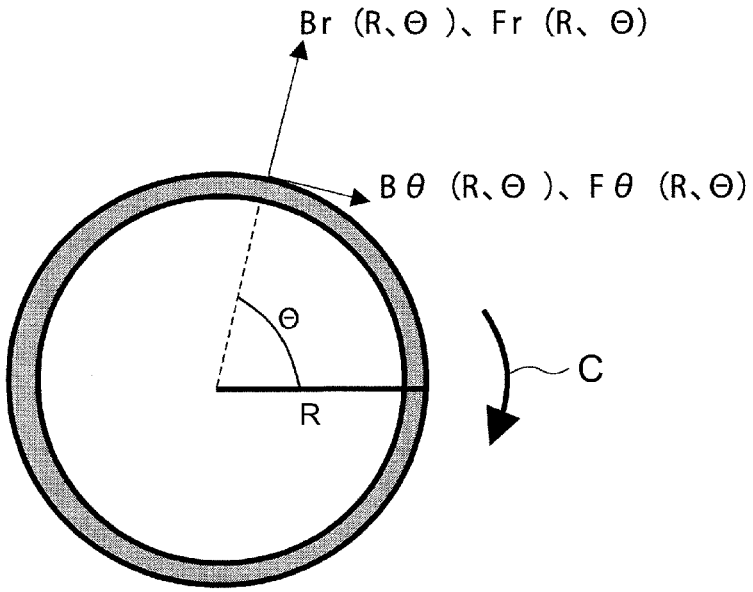
FIG. 7 is a schematic view for illustrating definitions of Br, Bθ, Fr and Fθ.

These components Br, Bθ, Fr and Fθ are defined as shown in FIG. 7. That is, in the case where the radius of the developing sleeve 44 is R and an angle at an arbitrary point on the outer peripheral surface of the developing sleeve 44 is Θ, at this arbitrary point, the respective components Br, Bθ, Fr and Fθ act as indicated as associated arrows. Each of the directions of the arrows represents a positive direction. Further, the peak value and half-width of the magnetic flux density in this embodiment represent those of the radial direction component Br of the magnetic flux density.

In FIG. 6, the position of the regulating blade 46 is indicated by a broken line, i.e., in the neighborhood of the angle of 80 degrees. Further, at the left side of this broken line, i.e., at the upstream side of the regulating blade 46 with respect to the sleeve rotational direction, Fθ is negative, so that the magnetic force acting on the magnetic carrier acts in the opposite direction to the sleeve rotational direction. In this embodiment, in this way, the magnetic flux density relationship among the respective magnetic poles is regulated as described above so that Fθ is negative at the upstream side of the regulating blade 46 with respect to the sleeve rotational direction. Incidentally, Fθ becomes a positive value in the neighborhood of the magnetic flux density peak value of the N2 pole and Fθ at this position is indicated by arrows E.

Figure 8:
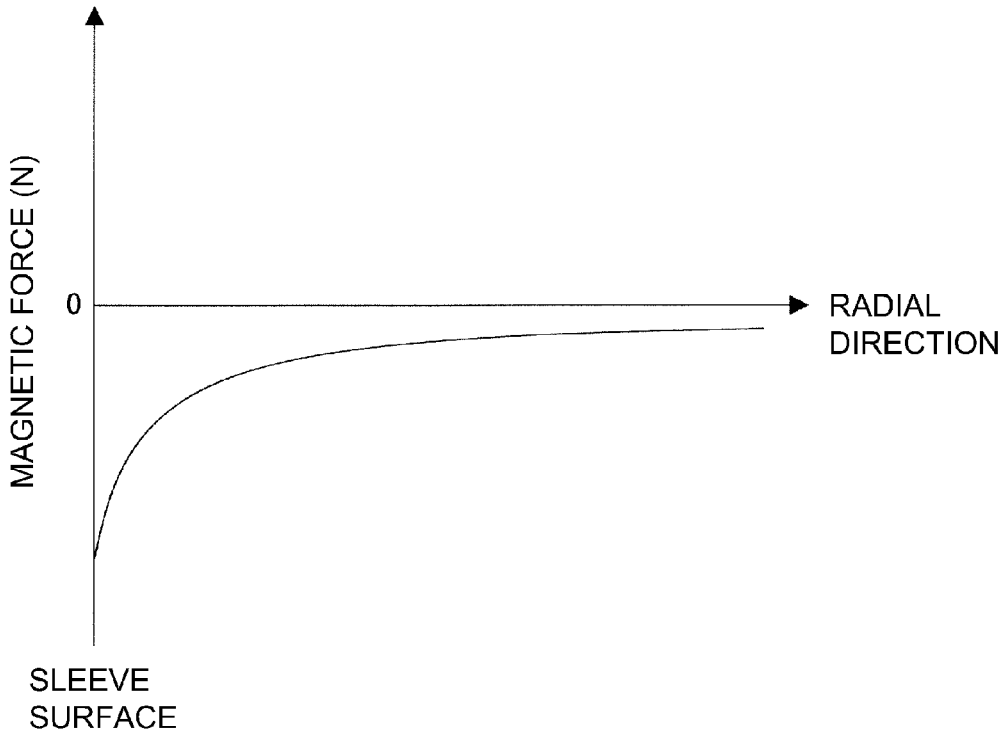
FIG. 8 is a schematic view showing a distribution of the magnetic force and the magnetic flux density on a surface of a developing sleeve in the First Embodiment.

Further, as shown in FIG. 8, in the case where the position of the developing sleeve 44 is the position of 0 (zero) on the ordinate, it is preferable that Fθ is negative at any position with respect to the radial direction of the developing sleeve 44 upstream of the regulating blade 46. Here, the ordinate in FIG. 8 represents the rotational direction of the developing sleeve 44 and the abscissa represents the radial direction of the developing sleeve 44. The position of 0 on the abscissa is the surface of the developing sleeve 44. The magnetic flux density is large at the surface of the developing sleeve 44 and is smaller with a distance from the sleeve surface. For this reason, depending on a magnetic flux density relationship between adjacent magnetic poles, it would be considered that Fθ is positive at a position distant from the sleeve surface. When Fθ is positive, as described later, the developer is pressed against the regulating blade 46, so that the immobile layer is liable to be generated. Therefore, as shown in FIG. 8, irrespective of the radial direction position of the regulating blade 46, it is preferable that the magnetic flux density relationship between the adjacent magnetic poles is regulated so that Fθ is negative.

Here, a calculation method of the magnetic force represented by the following formula will be described.

$$\vec{F}=(Fr,F\theta)$$

The magnetic force acting on the magnetic carrier is represented by the following formula:

$$\vec{F}=\frac{\mu-\mu_0}{\mu_0(\mu+2\mu_0)}2\pi b^3\nabla B^2$$

$\mu_0$ = SPACE PERMEABILITY $\mu$ = PERMEABILITY OF CARRIER $b$ = RADIUS OF CARRIER $B$ = MAGNETIC FLUX DENSITY

Therefore, the following formula is obtained.

$$\vec{F}\propto\nabla B^2=\frac{\partial}{\partial r}(Br^2+B\theta^2)\vec{e}_r+\frac{1}{r}\frac{\partial}{\partial\theta(B_r^2+B_\theta^2)}\vec{e}_\theta \tag{1}$$

$$\therefore\vec{F}\propto\underbrace{\left(B_r\frac{\partial B_r}{\partial r}+B_\theta\frac{\partial B_\theta}{\partial r}\right)\vec{e}_r}_{Fr}+\underbrace{\frac{1}{r}\left(B_r\frac{\partial B_r}{\partial\theta}+B_\theta\frac{\partial B_\theta}{\partial\theta}\right)\vec{e}_\theta}_{F\theta}$$

Therefore, when Br and Bθ are known, Fr and Fθ can be obtained. Here, the magnetic flux density Br can be measured by using, as a measuring device, a magnetic field measuring device ("MS-9902" (trade name), mfd. by F.W. BELL, Inc.). For example, the magnetic flux density Br is measured by setting a distance between a probe, which is a member of the measuring device, and the surface of the developing sleeve 44 at about 100 μm.

Further, Bθ can be obtained in the following manner. Vector potential $A_Z(R, \theta)$ at a measuring position of the magnetic flux density Br is obtained by using the measured magnetic flux density Br according to the following formula.

$$A_z(R, \theta) = \int_0^{\theta} RBr\,d\theta$$

Under a boundary condition of $A_Z$ (R, θ), $A_Z$ (r, θ) is obtained by solving the following equation.

$$\nabla^2 A_z(r;\theta)=0$$

Then, Bθ can be obtained from the following equation.

$$B_\theta = -\frac{\partial A_z(r, \theta)}{\partial r}$$

Br and Bθ measured and calculated in the above-described manner are applied to the above formulas, so that Fr and Fθ can be derived.

As described above, in order to make the direction of Fθ opposite from the sleeve rotational direction at the upstream position of the regulating blade 46, a maximum of Fr (absolute value) between the S2 pole and the N2 pole is made larger than a maximum of Fr (absolute value) between the S2 pole and the N1 pole. Here, Fr between the S2 pole and the N2 pole is the radial direction component (Fr) of the magnetic force acting on the magnetic carrier between the peak position of the magnetic flux density (Br) of the S2 pole and the peak position of the magnetic flux density (Br) of the N2 pole. Further, Fr between the S2 pole and the N1 pole is the radial direction component (Fr) of the magnetic force acting on the magnetic carrier between the peak position of the magnetic flux density (Br) of the S2 pole and the peak position of the magnetic flux density (Br) of the N1 pole.

Further, in order to regulate the values of Fr between the respective magnetic poles, a gradient of the magnetic flux density between the S2 pole and the N2 pole is made larger than a gradient of the magnetic flux density between the S2 pole and the N1 pole. That is, the gradient of Br between the adjacent two poles is increased, so that a maximum of B2 is generated between the adjacent two poles and thus the magnetic carrier is attracted to the direction in which B2 is large. Therefore, by making the gradient of the change in Br between the S2 pole and the N2 pole larger than the gradient of the change in Br between the S2 pole and the N1 pole, the direction of Fθ can be made opposite from the sleeve rotational direction at the position of the regulating blade 46.

According to this embodiment, the magnetic force component (Fθ) directed in the opposite direction to the sleeve rotational direction acts on the magnetic carrier contacting the upstream side of the regulating blade 46 and therefore the developer is not readily pressed against the upstream surface of the regulating blade 46. As a result, it is possible to suppress the generation of the immobile layer at the surface without exerting strong stress on the developer, so that the carrying amount of the developer carried on the developing sleeve 44 can be stably regulated by the regulating blade 46.

This point will be described with reference to FIG. 9. The developer carried and conveyed by the developing sleeve 44 is supplied to the developer stagnating portion 48. Then, the developer is, after striking against the regulating blade 46, divided into the developer which passes through the gap between the regulating blade 46 and the developing sleeve 44 and the developer which cannot pass through the gap between the regulating blade 46 and the developing sleeve 44 and remains at the developer stagnating portion 48. The stagnated developer has nowhere to go and then moves, in the neighborhood of the regulating blade 46, in a direction in which the developer is spaced from the developing sleeve 44 (in the upward direction in FIG. 9). Thereafter, motion of the developer at the developer stagnating portion 48 is determined by the rotational direction component Fθ of the magnetic force acting from the magnet 45.

In this case, when the direction of the rotational direction component Fθ of the magnetic force acting from the magnet 45 at the surface at the developer stagnating portion 48 side of the regulating blade 46 is the same as the sleeve rotational direction is pressed against the regulating blade 46.

Then, the developer forms the immobile layer to liable to result in the toner layer. On the other hand, the direction of the rotational direction component Fθ of the magnetic force acting from the magnet 45 at the developer stagnating portion 48 side of the regulating blade 46 is opposite from the sleeve rotational direction, the developer, in the neighborhood of the regulating blade 46, at the developer stagnating portion 48 mores in the develop to the sleeve rotational direction. As a result, it is possible to suppress the generation of the immobile layer at the developer stagnating portion, so that the generation of the toner immobile layer can be suppressed.

Figure 9:
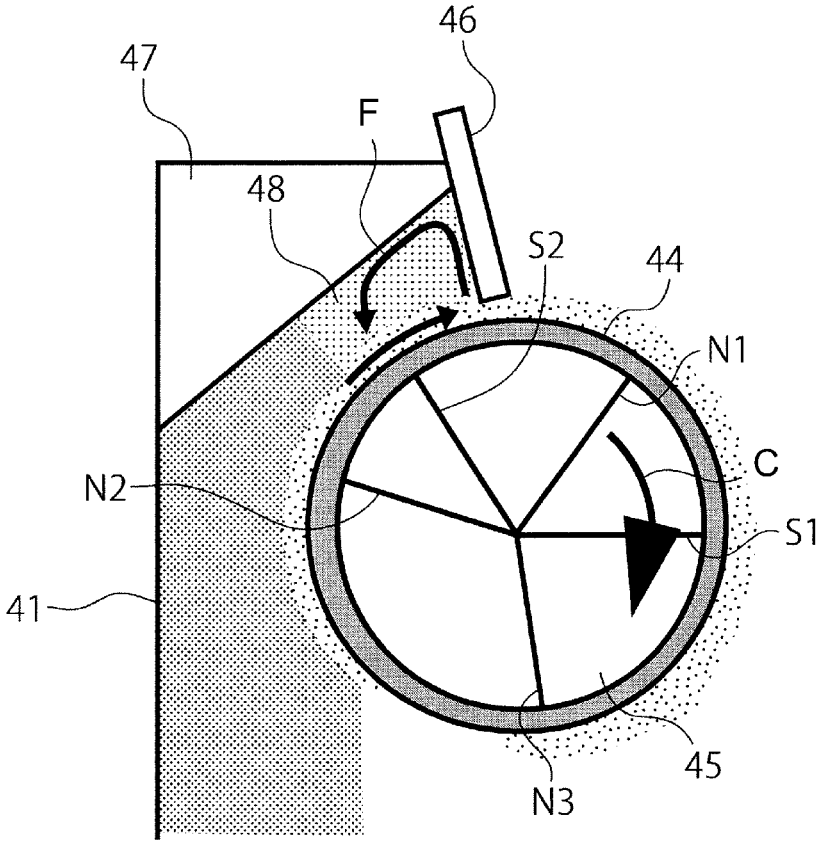
FIG. 9 is a partly enlarged view, of a part of FIG. 3, for illustrating a flow of the developer upstream of the regulating blade.

Incidentally, in this case, the motion of the developer at the developer stagnating portion 48 can be predicted so that the developer moves along an arrow F direction shown in FIG. 9. This also coincided with an observation result in an experiment conducted by the present inventors. Thus, by the movement of the developer at the upstream position of the regulating blade 46, the generation of the immobile layer is readily suppressed. Particularly, when Fθ directed in the opposite direction to the sleeve rotational direction is large at the position of the regulating blade 46, the motion of the developer at the developer stagnating portion 48 becomes active, thus being suitable in terms of the suppression of the generation of the immobile layer.

Next, a preferred range of Fθ in order to suppress the developer immobile layer was obtained in the following manner. With respect to the S2 pole closest to the regulating blade 46 when the amount of magnetization of the carrier is minimum (30 emu/cc), the intensity, half-width and interval from the cut pole of each of the magnetic poles N2 and N1 located upstream and downstream of the S2 pole (cut pole) with respect to the developing sleeve rotational direction are changed, so that Fθ changes its amplitude while becoming negative and then a state of the generation of the immobile layer was checked. The result is shown in Table 1. Further, in this case, the developer with the angle of repose of 50 degrees at which the immobile layer was most generated was used.

TABLE 1

| Fθ (N) at blade position | ILG*[1] |
|---|---|
| $5.0 \times 10^{-9}$ | ○ |
| $2.5 \times 10^{-9}$ | ○ |
| $1.5 \times 10^{-9}$ | ○ |
| $1.1 \times 10^{-9}$ | ○ |
| $1.0 \times 10^{-9}$ | x |

*[1]"ILG" represents immobile layer generation. "○" represents that the immobile layer was not generated, "x" represents that the immobile layer was generated.

From Table 1, it was possible to confirm that there is no immobile layer generation when Fθ is larger than $1.0\times 10^{-9}$ (N).

When the immobile layer generation can be suppressed, the amount of the developer carried on the developing sleeve 44 can be properly suppressed by the regulating blade 46, so that it is possible to stabilize the carrying amount for a long term. As a result, it is possible to suppress a fluctuation of the amount of the developer conveyed to the developing region where the developing sleeve 44 opposes the photosensitive member, so that a lowering in density of an image to be formed and an occurrence of density non-uniformity can be reduced.

Further, in this embodiment, the S2 pole as the first magnetic pole in the neighborhood of the regulating blade 46 and the N1 pole as the second magnetic pole are different in polarity and therefore different from the structure described in JP-A Hei 5-6103, the developer can be stably supplied to the developing sleeve. Further, the magnetic flux density relationship between the respective magnetic poles of the magnet 45 is only regulated and thus there is no need to provide another particular member, so that it is possible to achieve the above effect at a low cost.

Further, in this embodiment, the toner containing a wax is used. With respect to this wax-containing toner, by the friction at a boundary surface the immobile layer and the flowable layer, the wax having viscosity is present at the toner surface. As a result, the toner particles are liable to adhere to each other, so that there is a possibility that a toner agglomerate is generated to fluctuate the carrying amount of the developer on the developing sleeve 44. On the other hand, in this embodiment, as described above, the immobile layer is not readily generated and therefore it is possible to less generate the toner agglomerate even when the toner contains the wax.

<Second Embodiment>

Figure 10:
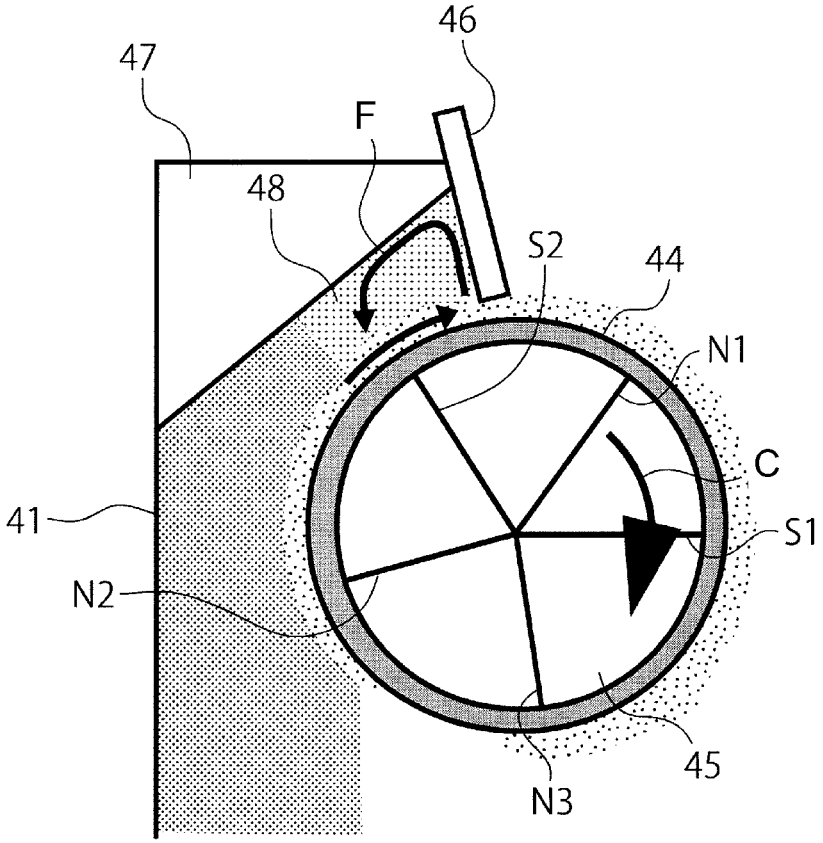
FIG. 10 is a partly enlarged view, of a part of FIG. 3, showing a developing device according to a Second Embodiment of the present invention.

Second Embodiment of the present invention will be described with reference to FIG. 10. In this embodiment, the peak values of the magnetic flux densities (Br) of the N2 pole as the third magnetic pole and the N1 pole as the second magnetic pole which constitute the magnet 45 are set so that the former peak value is larger than the latter peak value. Thus, the rotational direction component (Fθ) of the magnetic force is caused to act, in the opposite direction to the sleeve rotational direction, on the magnetic carrier contacting the upstream side of the regulating blade 46 with respect to the sleeve rotational direction.

Incidentally, the half-width of the magnetic flux density of the N2 pole may preferably be not less than the half-width of the magnetic flux density of the N1 pole. Further, the sleeve rotational direction interval between the peak values of the magnetic flux densities of the S2 pole and the N2 pole may preferably be not more than the sleeve rotational direction interval between the peak values of the magnetic flux densities of the S2 pole and the 1 pole.

However, when the rotational direction component (Fθ) of the magnetic force acts, in the develop to the sleeve rotational direction, on the magnetic carrier contacting the upstream side of the regulating blade 46 with respect to the sleeve rotational direction, it is possible to appropriately set the above-described half-widths and peak value intervals. That is, in this embodiment, with respect to these half-widths and peak value intervals, by making the magnetic flux density peak value of the N2 pole larger than the magnetic flux density peak value of the N1 pole, Fθ may only be required to be directed in the develop to the sleeve rotational direction at the upstream position of the regulating blade 46.

A specific setting example in this embodiment is shown in Table 2.

TABLE 2

| | |
|---|---|
| N1 (Br) PV*1 | 400 G |
| N2 (Br) PV*2 | 800 G |
| N1 HW*3 | 30 degrees |
| N2 HW*4 | 30 degrees |
| S2-N1 angle | 60 degrees |
| S2-N2 angle | 60 degrees |

*1"N1 (Br) PV" is the peak value of Br of the N1 pole.
*2"N2 (Br) PV" is the peak value of Br of the N2 pole.
*3"N1 HW" is the half-width of the N1 pole.
*4"N2 HW" is the half-width of the N2 pole.

In the constitution of Table 2, the magnetic flux density peak value of the N2 pole is two times the magnetic flux density peak value of the N1 pole. On the other hand, the magnetic flux density half-widths of the N2 pole and the N1 pole are the same, and the peak value interval between the S2 pole and the N2 pole and the peak value interval between the S2 pole and the N1 pole are also the same. Also in this embodiment, the generation of the immobile layer can be suppressed. Other structures and functions are the same as those in First Embodiment described above.

<Third Embodiment>

Figure 11:
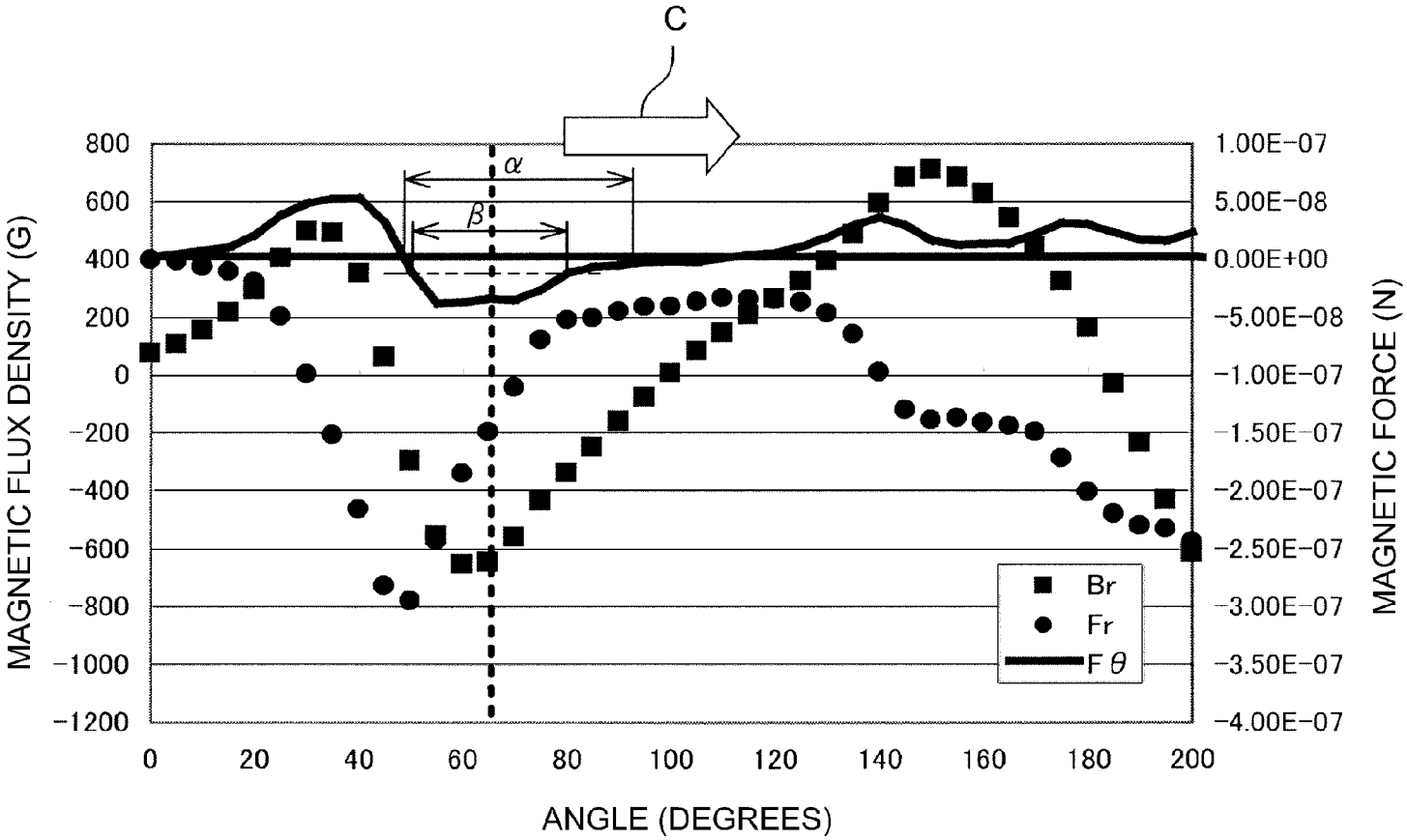
FIG. 11 is a graph showing a relationship between a magnetic flux density and a magnetic force in the neighborhood of a regulating blade in a Third Embodiment.
Figure 12:
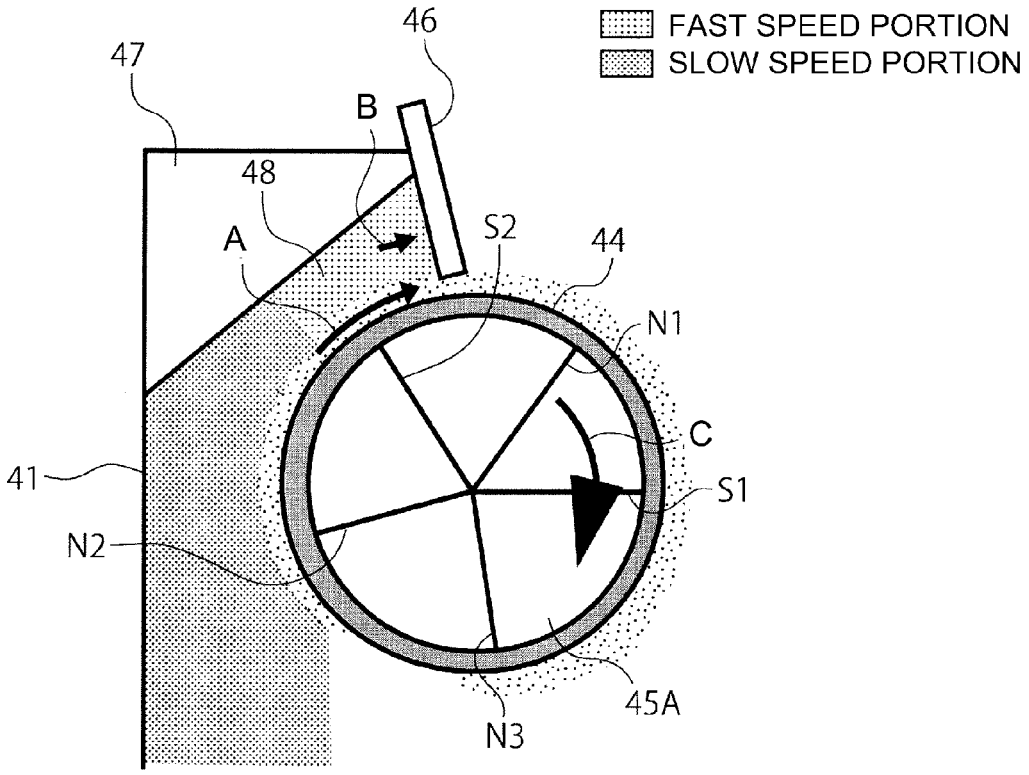
FIG. 12 is a schematic view for illustrating a conventional developing device.

Third Embodiment of the present invention will be described based on FIG. 11 while making reference to FIG. 3 and the like. In this embodiment, the regulating blade 46 is disposed within a region, of the region in which the rotational direction component of the magnetic force acts in the opposite direction to the sleeve rotational direction, in which the rotational direction component is larger than ½ of the maximum. That is, the position of the regulating blade 46 indicated by the broken line is located within a region β, of a region α in which Fθ is negative in FIG. 11, in which the rotational direction component is larger than ½ of the maximum of Fθ in term of the absolute value. As a result, the rotational direction component (F acting, in the opposite direction to the sleeve rotational direction, on the magnetic carrier generating the upstream side of the regulating blade 46 with respect to the sleeve rotational direction can be made large, so that the generation of the immobile layer can be more suppressed.

This embodiment is preferably applicable to a system in which a carrier with a small amount of magnetization is used. First, the carrier used in this embodiment will be described. In this embodiment, the carrier of 40 μm in volume-average particle size, $5\times10^8$ Ω.cm in volume resistivity and 180 emu/cc in amount of magnetization is used. A proper range of the amount of magnetization of the magnetic carrier is 30-300 emu/cm$^3$, preferably 100-280 emu/cm$^3$. When the amount of magnetization is less than 30 emu/cm$^3$, the amount of the carrier deposition on the photosensitive member 1 is increased and in addition, magnetic application and conveyance of the developer on the developing sleeve 44 cannot be effected. When the amount of the magnetization is more than 300 emu/cm$^3$, image non-uniformity due to the magnetic brush chain is liable to occur.

Further, by optimizing the amount of magnetization of the magnetic carrier and at the same time by optimizing the ranges of the particle size and resistivity (specific resistance) of the magnetic carrier, it is possible to prevent further reliably the carrier deposition and the image deterioration. That is, when the number-average particle size of the magnetic carrier falls within the range of 10-60 μm, the deposition of the carrier with a small particle size on the photosensitive drum can be prevented and sweep non-uniformity of the image by the carrier with a large particle size can be made less visible. By setting the resistivity of the carrier within the range of $10^7$-$10^{14}$ Ω.cm, even with respect to the carrier with a low amount of magnetization, the carrier deposition due to the electric charge injection can be prevented and the image deterioration due to charge-up of the carrier can be prevented.

Generally, when the carrier with the small amount of magnetization is used, stress on the developer in the developing container 41 is decreased, so that the lifetime extension can be achieved. Further, the magnetic brush is soft and therefore the frictional force against the photosensitive member 1 is decreased. For this reason, there is the advantage that the toner subjected to the development is not disturbed and thus high quality can be achieved. On the other hand, the magnetic force acting from the magnet 45 on the magnetic carrier contacting the upstream side of the regulating blade 46 with respect to the developing sleeve rotational direction is decreased relative to that in the case of using the carrier with a large amount of magnetization, so that the motion of the developer tends to become slow. As a result, even in the case where the rotational direction component Fθ of the magnetic force acting from the magnet 45 on the magnetic carrier contacting the upstream side of the regulating blade 46 with respect to the developing sleeve rotational direction is directed in the opposite direction to the sleeve rotational direction, when the magnitude of the rotational direction component Fθ is excessively small, the immobile layer is liable to generate.

Therefore, the direction the rotational direction component Fθ acting from the magnet 45 on the magnetic carrier contacting the upstream side of the regulating blade 46 with respect to the sleeve rotational direction is made opposite from the sleeve rotational direction. In addition, the regulating blade 46 is disposed at the position where the rotational direction component is larger than ½ of the maximum in the region in which the direction of the rotational direction component is opposite from the sleeve rotational direction. As a result, the force exerted on the developer at the developer stagnating portion 48 can be made further large and even when the above carrier is used, the carrier can be moved similarly as in the above-described embodiments. As a result, similarly as in the above-described embodiments, the generation of the immobile layer of the developer can be suppressed. Other structures and functions are the same as those in First Embodiment.

<Fourth Embodiment>

Fourth Embodiment of the present invention will be described with reference to FIG. 3 and the like. In the above-described embodiments, the absolute values of the peak values of Br of the N1 pole and the N2 pole or the peak value interval of Br between the N1 pole and the N2 pole was particularly regulated. However, in order to cause the rotational direction component (Fθ) of the magnetic force to act, in the develop to the sleeve rotational direction, on the magnetic carrier contacting the upstream side of the regulating blade 46 with respect to the sleeve rotational direction, the magnetic flux density half-width of the N2 pole may also be made larger than the magnetic flux density half-width of the N1 pole.

In this case, it is preferable that the sleeve rotational direction interval between the magnetic flux density peak values of the S2 pole and the N2 pole is not more than the sleeve rotational direction interval between the magnetic flux density peak values of the S2 pole and the N1 pole. Further, the magnetic flux density peak value of the N2 pole may preferably be not less than the magnetic flux density peak value of the N1 pole. Incidentally, when the half-widths are regulated as described above and Fθ at the upstream position of the regulating blade 46 is directed in the opposite direction to the sleeve rotational direction, the above-described peak value intervals and peak values can be approximately set. Other structures and functions are the same as those in First Embodiment.

<Other Embodiments>

The above-described embodiments can be executed by being appropriately combined. Further, the present invention is not limited to the above-described constitutions but may employ various constitutions in accordance with the present invention. In addition to the constitutions, the present invention is not limited so long as the constitution employed is such that the gradient of the change in Br between the S2 pole and the N2 pole is larger than the gradient of the change in Br between the S2 pole and the N1 pole.

Further, the material of the photosensitive member 1 used in the image forming apparatus, constitutions of the developer and image forming apparatus, and the like in the above-described embodiments are not limited to those described above but the present invention is applicable to various developers and image forming apparatuses. Specifically, the color of the toner, the number of colors, the presence or absence of the wax, the order of development with the respective toners, the number of developer carrying members, the amount of magnetization, and the like are not limited to those in the above-described embodiments.

Further, here, with respect to the constitution of the developing device, in each of the above-described embodiments, the developing chamber 41*a* and the stirring chamber 41*b* are horizontally disposed. However, the present invention is also applicable to a developing device in which the developing chamber 41*a* and the stirring chamber 41*b* are vertically disposed and other developing devices with different constitutions.

Further, the S2 pole as the developer regulating pole is not necessarily required to be disposed upstream of the regulating blade 46 with respect to the rotational direction of the developing sleeve 44. Further, in the case where the magnetic poles between which the regulating blade 46 is interposed are different in polarity, the present invention is applicable even when the magnetic pole upstream of the cut pole S2 has the same polarity as that of the cut pole S2.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 288430/2010 filed Dec. 24, 2010, which is hereby incorporated by reference.

What is claimed is:

1. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein the magnetic poles include a first magnetic pole closest to said regulating member, a second magnetic pole provided adjacent to and downstream of the first magnetic pole with respect to the rotational direction of said developer carrying member, and a third magnetic pole adjacent to and upstream of the first magnetic pole with respect to the rotational direction of said developer carrying member, wherein the second magnetic pole and the third magnetic pole are different in polarity from the first magnetic pole, and wherein a maximum of a component of the magnetic force, with respect to a radial direction of said developer carrying member, acting on the magnetic carrier between a peak position of a magnetic flux density of the first magnetic pole and a peak position of a magnetic flux density of the third magnetic pole is larger than a component of the magnetic force, with respect to the radial direction of said developer carrying member, acting on the magnetic carrier between the peak position of the magnetic flux density of the first magnetic pole and a peak position of a magnetic flux density of the second magnetic pole.

2. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein the magnetic poles include a first magnetic pole closest to said regulating member, a second magnetic pole provided adjacent to and downstream of the first magnetic pole with respect to the rotational direction of said developer carrying member, and a third magnetic pole adjacent to and upstream of the first magnetic pole with respect to the rotational direction of said developer carrying member, wherein the second magnetic pole and the third magnetic pole are different in polarity from the first magnetic pole, and wherein a magnetic flux density gradient between the first magnetic pole and the third magnetic pole is larger than a magnetic flux density gradient between the first magnetic pole and the second magnetic pole.

3. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein the magnetic poles include a first magnetic pole closest to said regulating member, a second magnetic pole provided adjacent to and downstream of the first magnetic pole with respect to the rotational direction of said developer carrying member, and a third magnetic pole adjacent to and upstream of the first magnetic pole with respect to the rotational direction of said developer carrying member, wherein the second magnetic pole and the third magnetic pole are different in polarity from the first magnetic pole, and wherein on a surface of said developer carrying member, an interval between a peak position of a magnetic flux density of the first magnetic pole and a peak position of a magnetic flux density of the third magnetic pole with respect to the rotational direction of said developer carrying member is smaller than an interval between the peak position of the magnetic flux density of the first magnetic pole and a peak position of a magnetic flux density of the second magnetic pole with respect to the rotational direction of said developer carrying member.

4. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein the magnetic poles include a first magnetic pole closest to said regulating member, a second magnetic pole provided adjacent to and downstream of the first magnetic pole with respect to the rotational direction of said developer carrying member, and a third magnetic pole adjacent to and upstream of the first magnetic pole with respect to the rotational direction of said developer carrying member, wherein the second magnetic pole and the third magnetic pole are different in polarity from the first magnetic pole, and wherein a peak value of a magnetic flux density of the third magnetic pole is larger than a peak value of a magnetic flux density of the second magnetic pole.

5. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein said regulating member is disposed in a region where a value of a magnetic flux density of a developer carrying member radial direction component is half of a peak value of the magnetic flux density.

6. A developing device according to claim 5, wherein said regulating member is disposed in a region where the value of the magnetic flux density of the developer carrying member radial direction component is in a downstream side of the peak value of the magnetic flux density with respect to a rotational direction of said developer carrying member.

7. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, wherein in an immediately upstream region of said regulating member, a magnetic force of a developer carrying member radial direction component acting on the magnetic carrier decreases toward a downstream side of a rotational direction of said developer carrying member.

8. A developing device comprising:

a developer carrying member for carrying a developer containing a magnetic carrier and a non-magnetic toner and for developing an electrostatic latent image formed on an image bearing member, with said developer carrying member having a direction of rotation;

a magnet, provided in said developer carrying member and including a plurality of magnetic poles disposed along a circumferential direction of said developer carrying member, for carrying the developer on said developer carrying member; and a regulating member, provided opposite to said developer carrying member with a predetermined spacing in a region in which the magnetic poles are disposed such that magnetic poles different in polarity are adjacent to each other, for regulating an amount of the developer carried on said developer carrying member, wherein the magnetic poles are disposed so that a circumferential direction component of a magnetic force acting on the magnetic carrier contacting at least a part of an upstream regulating surface of said regulating member with respect to the direction of rotation of said developer carrying member is opposite from the direction of rotation, and wherein when space permeability is $\mu_0$, permeability of the magnetic carrier is $\mu$, a radius of the magnetic carrier is b, and a magnetic flux density vector formed on a surface of said developer carrying member is B, magnetic force F is represented by the following formula:

$$\vec{F} = \frac{\mu - \mu_0}{\mu_0(\mu + 2\mu_0)} 2\pi b^3 \nabla B^2$$

wherein in an entire region of the upstream regulating surface of said regulating member, the circumferential direction component of the magnetic force acting on the magnetic carrier contacting said regulating member is opposite from the direction of rotation.

* * * * *